US007793449B2

(12) United States Patent
Groch et al.

(10) Patent No.: US 7,793,449 B2
(45) Date of Patent: Sep. 14, 2010

(54) CLIP

(75) Inventors: Hans-Werner Groch, Stuttgart (DE); Steffen Seiffarth, Filderstadt (DE)

(73) Assignee: Esselte Corporation, Melville, NY (US)

( * ) Notice: Subject to any disclaimer, the term of this patent is extended or adjusted under 35 U.S.C. 154(b) by 87 days.

(21) Appl. No.: 10/953,882

(22) Filed: Sep. 29, 2004

(65) Prior Publication Data

US 2005/0217078 A1 Oct. 6, 2005

(30) Foreign Application Priority Data

Apr. 6, 2004 (GB) ..... 0407824.2

(51) Int. Cl.
*G09F 23/10* (2006.01)

(52) U.S. Cl. ..... 40/641; 40/360; 24/67 R

(58) Field of Classification Search ..... 40/641, 40/302, 360, 659, 658; 24/67.9, 67 R; 264/239, 264/250, 260
See application file for complete search history.

(56) References Cited

U.S. PATENT DOCUMENTS

| | | | | | |
|---|---|---|---|---|---|
| 1,079,209 | A | * | 11/1913 | Burckhart | 40/641 |
| 1,826,614 | A | * | 10/1931 | Graff et al. | 40/652 |
| 1,897,755 | A | | 2/1933 | Greene | |
| 2,341,121 | A | | 2/1944 | Schaaf | 24/259 |
| 2,938,252 | A | | 5/1960 | Scheemaeker | 24/66 |
| 3,225,469 | A | * | 12/1965 | Chase | 40/641 |
| 3,290,810 | A | * | 12/1966 | Morena | 40/641 |
| 3,438,143 | A | * | 4/1969 | Wolfersberger, Jr. | 40/641 |
| 4,011,673 | A | * | 3/1977 | Levine | 40/641 |
| 4,286,358 | A | | 9/1981 | Levin | 24/67 R |
| 4,384,417 | A | | 5/1983 | Thompson | 40/11 A |
| 4,389,755 | A | | 6/1983 | Villa-Real | 24/67.9 |
| 4,597,208 | A | * | 7/1986 | Chevillot | 40/301 |
| 4,928,361 | A | | 5/1990 | Brown | 24/67.9 |
| 4,951,408 | A | | 8/1990 | Banks | 40/641 |
| 5,010,629 | A | | 4/1991 | Hirzel | 24/67.9 |
| 5,320,345 | A | * | 6/1994 | Lai et al. | 473/601 |
| 5,357,653 | A | | 10/1994 | van Ardenne | 24/67.9 |
| 5,398,384 | A | | 3/1995 | Rinard | 24/67.9 |
| 5,870,802 | A | | 2/1999 | Goldman | 24/67.9 |
| D451,963 | S | | 12/2001 | Molenaar | D19/88 |
| 6,332,285 | B1 | * | 12/2001 | Aaldenberg et al. | 40/641 |
| 6,474,008 | B1 | * | 11/2002 | Hofman et al. | 40/359 |
| 6,553,701 | B1 | * | 4/2003 | Neisen et al. | 40/645 |
| 6,722,309 | B1 | | 4/2004 | Ben-Dor et al. | 116/234 |
| 7,600,871 | B2 | * | 10/2009 | Lane et al. | 351/47 |

FOREIGN PATENT DOCUMENTS

| | | | |
|---|---|---|---|
| GB | 2 277 314 | A | 10/1994 |
| WO | WO 02/098679 | A1 | 12/2002 |

* cited by examiner

*Primary Examiner*—William L. Miller
(74) *Attorney, Agent, or Firm*—Dorsey & Whitney LLP

(57) ABSTRACT

A clip is described that includes a clipping part for clipping to an object, and a tab part arranged to extend from the clipping part. The tab part includes a first plastics material and a second rubber material. This allows the tab part to be marked with ink from a conventional pen.

23 Claims, 11 Drawing Sheets

CLIP

BACKGROUND ART

The present invention relates to a clip and in particular, stationery clips to be used with paper, card or the like.

Various different clips are well known for holding together a plurality of sheets of paper. Examples include a bull dog clip and the well known basic or common wire paper clip.

Clips have also been proposed for marking a particular page or a particular part of a page. For example, clips in the shape of an arrow can be used to indicate where a signature is needed. Clips are also known which have a tab portion which protrudes beyond the edge of a page or divider to which the clip has been attached. This allows a particular page or section to be easily referenced. The tab is, however, made of plastic and is only possible to be marked with a suitable water proof marker. This is inconvenient for the user if they do not have the required marker to hand.

It has also been proposed to provide clips with advertising across one of the clipping parts (WO02/28217).

Despite these items, there still remains a need for new clips that can be used, for example, to mark pages or to attach information to a sheet.

SUMMARY OF THE INVENTION

The present invention now provides a clip that addresses the problems identified above. In particular, according to one aspect of the invention a clip includes a clipping part for clipping to an object, and a tab part arranged to extend from the clipping part. The tab part includes a first plastics material and a second rubber material, the rubber material being markable with ink from a conventional pen.

In a beneficial embodiment, the plastics material comprises polypropylene or polystyrene. The rubber material preferably comprises a thermoplastic rubber or a thermoplastic elastomer, and the plastics material and rubber material may be bonded together. Alternately, the plastics material and the rubber material may have a form locking connection therebetween. Such a form locking connection is preferably provided by the rubber material extending through the plastics material, and having a region at either end of the rubber material to engage the plastics material. The rubber material advantageously has a Shore Hardness of between 55 and 95, and in a preferred implementation, between 70 and 90. These type of rubber materials can be marked with an aqueous ink from a conventional ball-point pen.

In an embodiment, the clipping part is partially received in the tab part. In addition, at least one of the plastics material and the rubber material may be molded. Preferably, a raised portion is provided on a side of the tab part opposite to that which has the rubber material. The raised portion may include writing, a logo, a design or a picture. In a beneficial implementation, the plastics material and the rubber material have a form locking connection therebetween and the form locking connection is arranged to be coplanar with a surface of the raised portion.

According to another aspect of the invention, provided is a method of making a clip that includes a clipping part for clipping to an object and a tab part arranged to extend from the clipping part. The tab part having a material markable with ink from a pen. The method includes inserting the clipping part into a first part of a mold, closing the mold with a second part, injecting a plastics material, removing one part of the mold and replacing it with a third mold part, introducing a rubber material into the mold to thereby produce the material markable with ink from a pen, and removing the clip from the mold.

In an advantageous implementation, vertical injection molding is used. A common first mold part may be used, and the method may further include removing a portion of the mold part and replacing it with a different part. Preferably, removing a portion of the first mold part takes place before the step of introducing a rubber material.

According to another aspect of the invention, provided is a clip including a clipping part for clipping to an object, and a tab part arranged to extend from the clipping part. The clipping part includes a material markable with ink from a pen, and the tab part has an opening therethrough to accommodate a portion of the clipping part.

In an embodiment, the clipping part is made of at least one of a metal and a plastic. Advantageously, the tab part is molded onto the clipping part. In an implementation, a part of the clipping part is received in the tab part. Preferably, the clipping part and the tab part are made of the same material. In an embodiment, the clip has a one piece structure so that the tab part and the clipping part are integral. This can be achieved by molding the two components together according to the method described herein.

According to another aspect of the invention, provided is a clip that includes a clipping part for clipping to an object, and a tab part arranged to extend from the clipping part. The tab part includes a material markable with ink from a pen and has a portion protruding from the tab part on a side opposite to that from which the clipping part extends.

In another aspect of the invention, provided is a clip that includes a clipping part for clipping, and a tab part arranged to extend from the clipping part. Again, the tab part comprises a material that is markable with ink from a conventional pen.

In an advantageous embodiment, the tab part is provided by at least one layer applied to the clipping part. Preferably, the layer is adhered to the clipping part. In an implementation, the layer has a slot, the clipping part engaging with the slot. The clipping part may include first and second parts. In this implementation, the first part may be arranged on one side of the layer and the second part arranged on the other side of the layer. Preferably, at least one further layer is attached to the clipping part. Advantageously, at least one of the layer and the further layer, if provided, is arranged to be a material capable of being marked by ink. In a preferred implementation, the layer and the further layer encapsulate the clipping part. At least one of the first layer and the further layer, if provided, includes at least one of a paper layer, a plastic layer, a metallic layer, and a textile layer. In an implementation, at least one of the first layer and the further layer, if provided, is transparent or is opaque. In another beneficial embodiment, the clipping part includes an opening and a resilient tongue. Preferably, the opening and tongue are in the same plane. Advantageously, the tongue is mounted so as to extend towards a plane containing the opening. The tongue may be substantially rectangular, triangular, square, circular, semi-circular, or ovoid. A part of the clipping part may be received in the tab part. Preferably, the tab part comprises two sides connectable together, and the two sides may be hinged along one side thereof. The clip may have a substantially T shape, figure eight shape, rectangular shape, circular shape, triangular shape, semi-circular shape, square shape, elliptical shape or ovoid shape. In an embodiment wherein the clipping part has a first side and a second side, the first and second sides are resiliently biased one towards the other for at least part of the first and second sides. Preferably, an opening is defined between the corresponding edges of the first and second sides adjacent to where the first and second sides are connected. In an advantageous embodiment, at least one of the sides includes a mark indicating a direction in which the clip is to be moved relative to material to be clipped. Preferably, the indication includes one of a mark or a cut out portion.

According to another aspect of the invention, provided is a clip that includes a resilient member arranged to be attached to at least one sheet, and a first layer attached to the resilient member, the layer comprising a material capable of being marked by ink.

According to another aspect of the invention, there is provided a clip having a first part comprising an opening and a second part arranged to extend partially above the opening and partially into the plane containing the opening, wherein materials to be clipped are arranged to lie between the first part and the second part.

In an advantageous implementation, the second part is biased at least partially towards the opening. Preferably, the second part has a first end connected to the first part and a second end remote from the first end, the second end being arranged to extend into the plane of the opening. The first end may be arranged to extend away from the plane of the opening so that the second part partially extends above the opening. The opening is preferably defined by walls, the walls having a height on the side adjacent the opening which is less than that on the side remote from the opening.

According to another aspect of the invention, there is provided a clip having a first part that includes an opening and a second part arranged to cooperate with the first part so that materials to be clipped are arranged to lie between the first part and the second part, wherein the opening is defined by walls, the walls having a height on the side adjacent the opening which is less than that on the side remote from the opening.

BRIEF DESCRIPTION OF THE DRAWING FIGURES

Other aspects, purposes and advantages of the invention will become clear after reading the following detailed description with reference to the accompanying drawings, in which.

Figure 4:
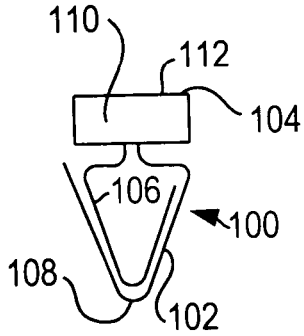
Figure 5A:
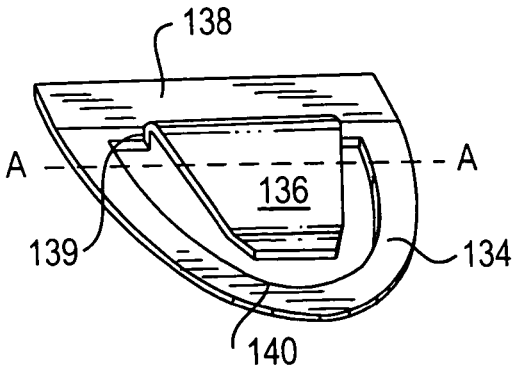
Figure 3A:
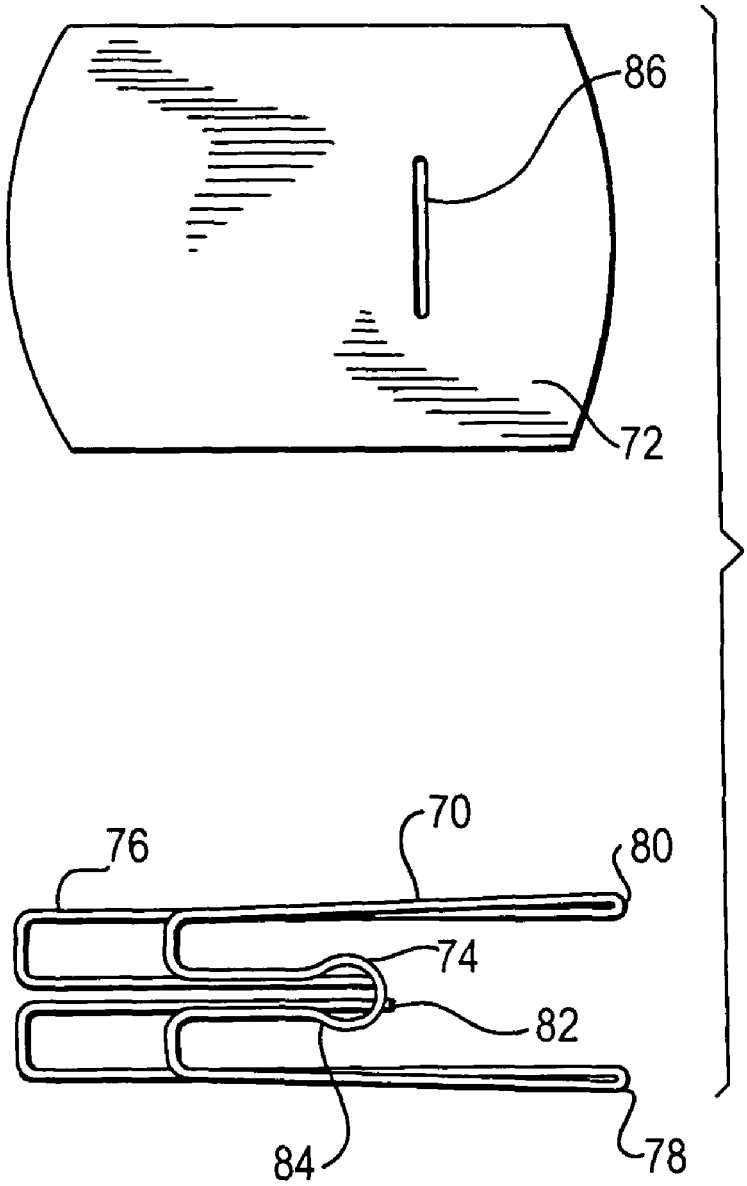
Figure 3B:
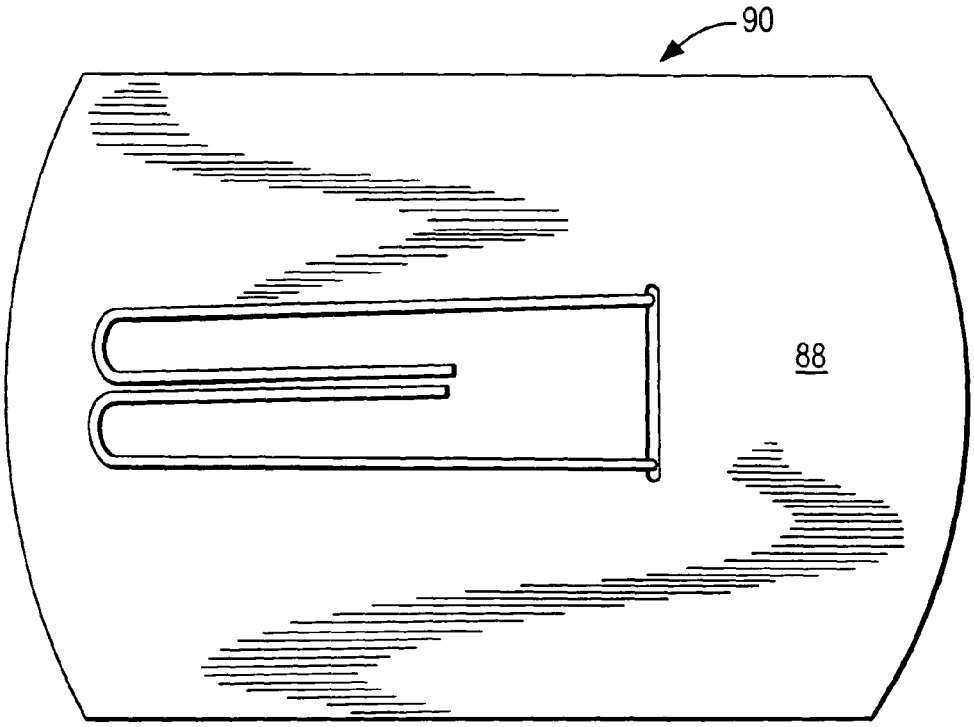
Figure 3C:
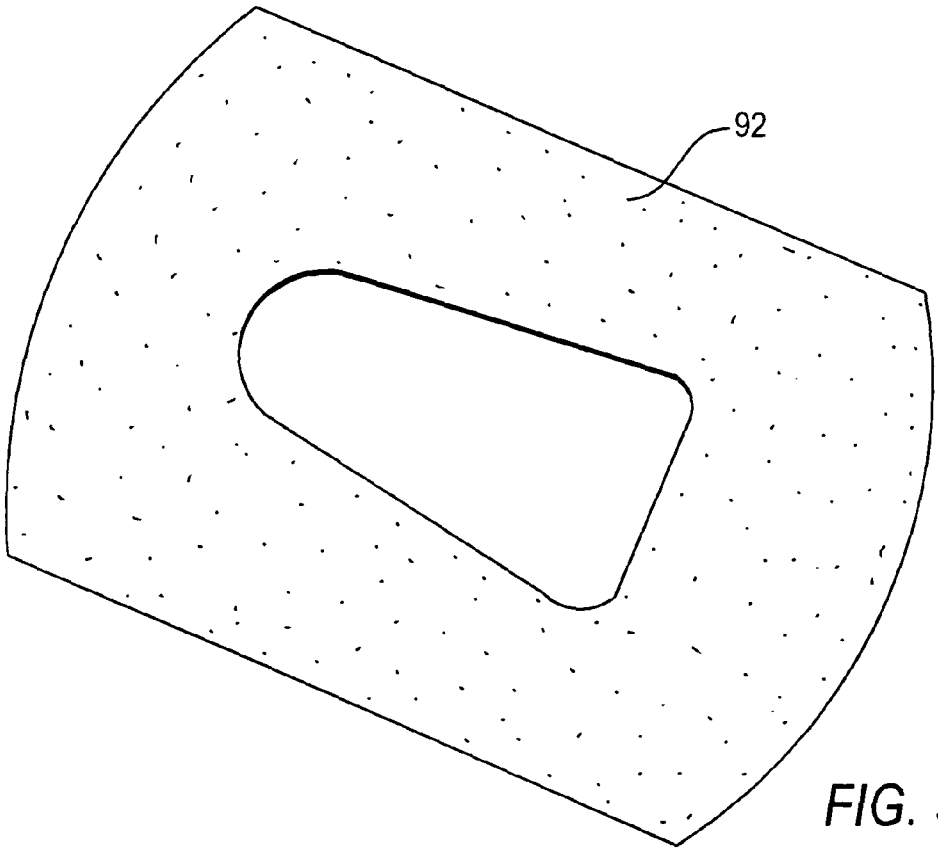
Figure 5B:
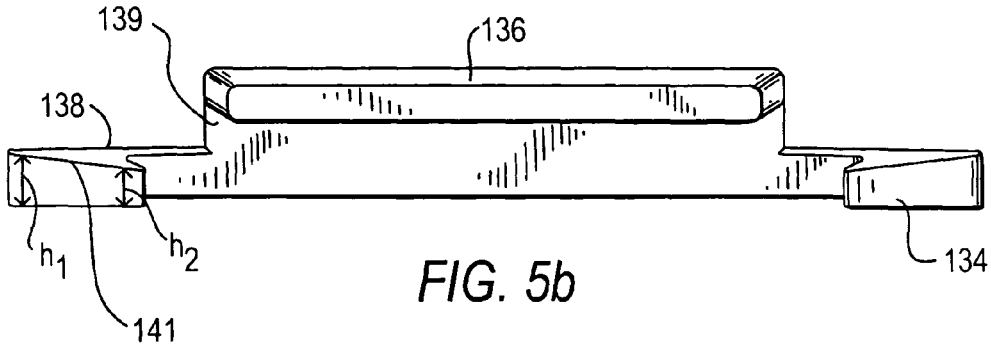

FIGS. 3*a* to 3*c* show various clips embodying the present invention when used as markers;

FIG. 4 shows a further embodiment of the present invention;

FIG. 5*a* shows a view from above of a further embodiment of the present invention;

FIG. 5*b* shows a cross-section of the clip of FIG. 5*a;*

Figure 6:
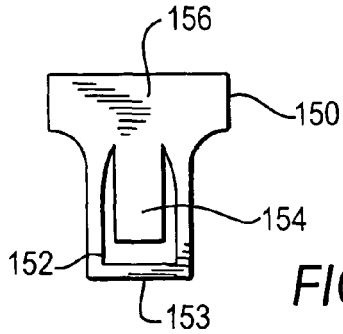
Figure 7:
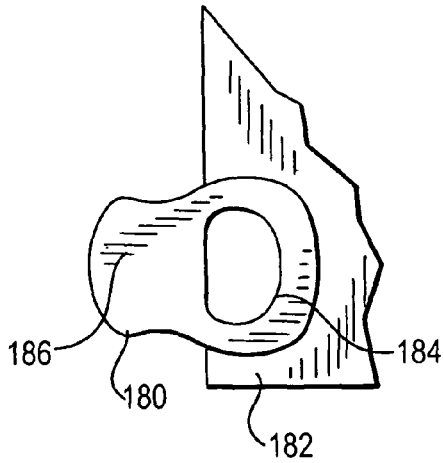
Figure 8A:
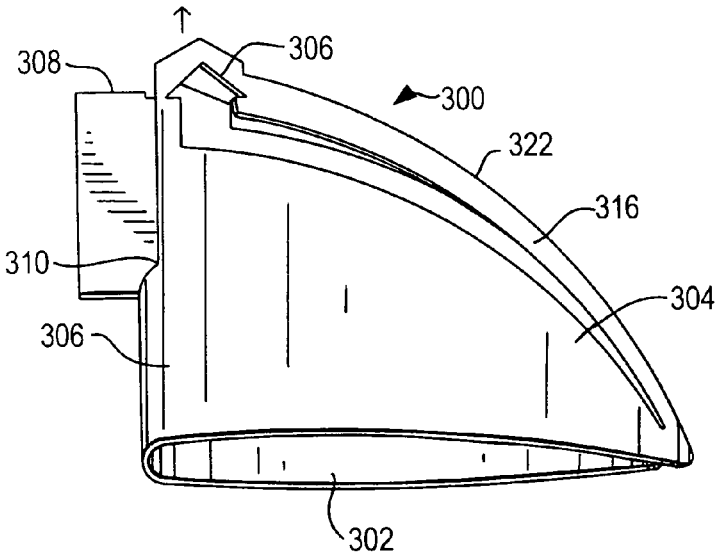
Figure 8B:
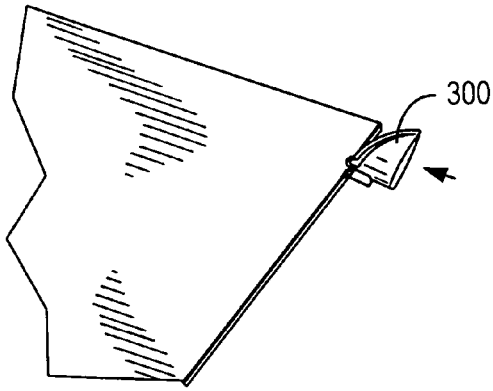
Figure 8C:
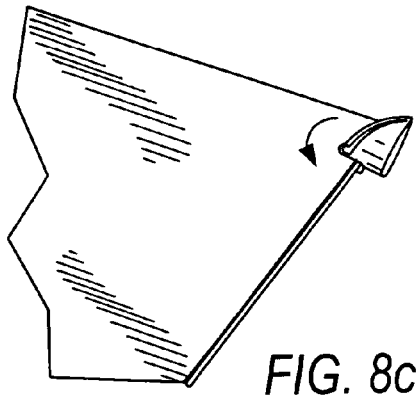
Figure 8D:
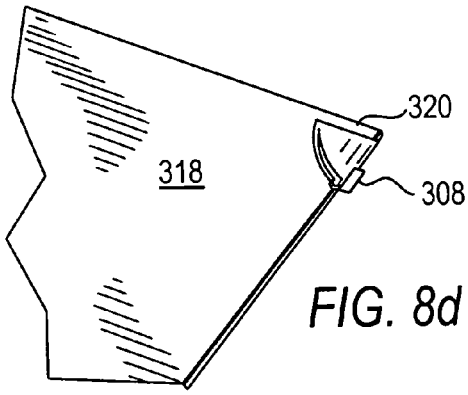
Figure 9A:
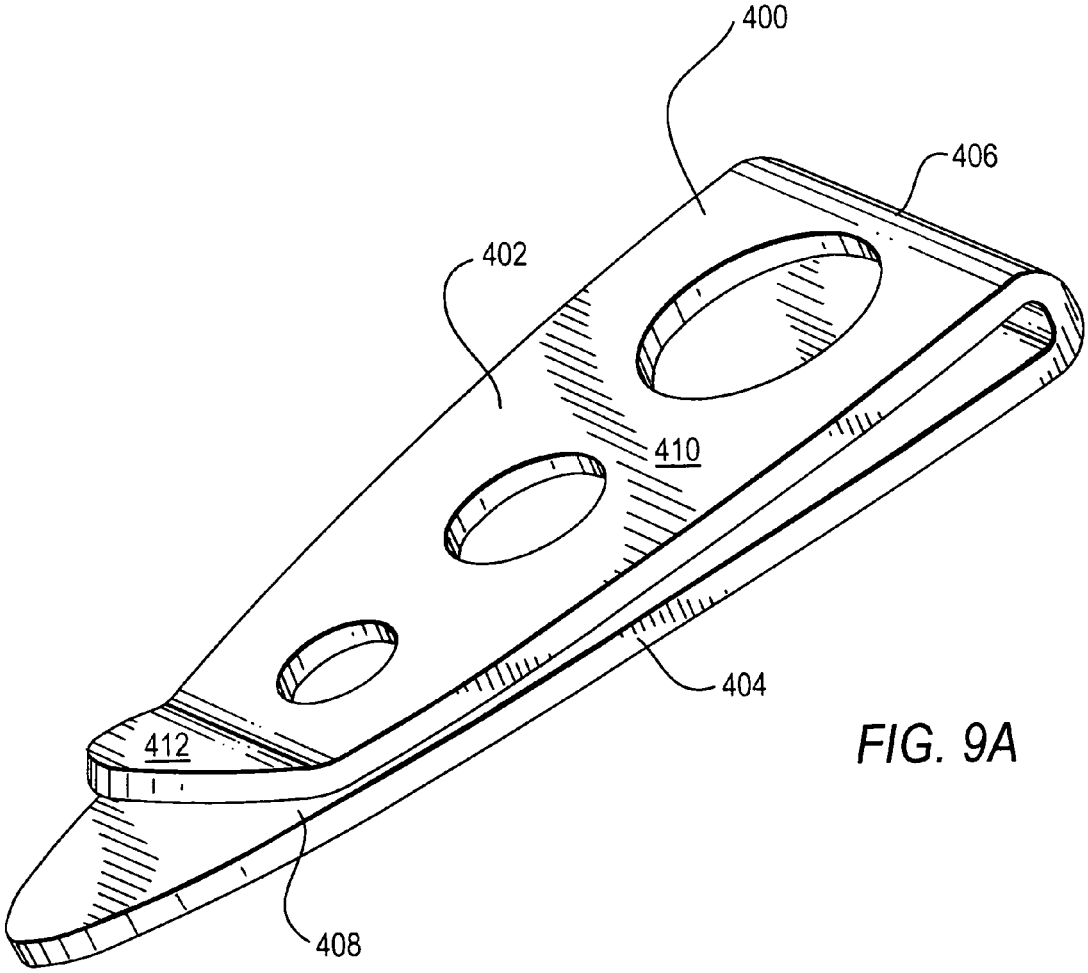
Figure 9B:
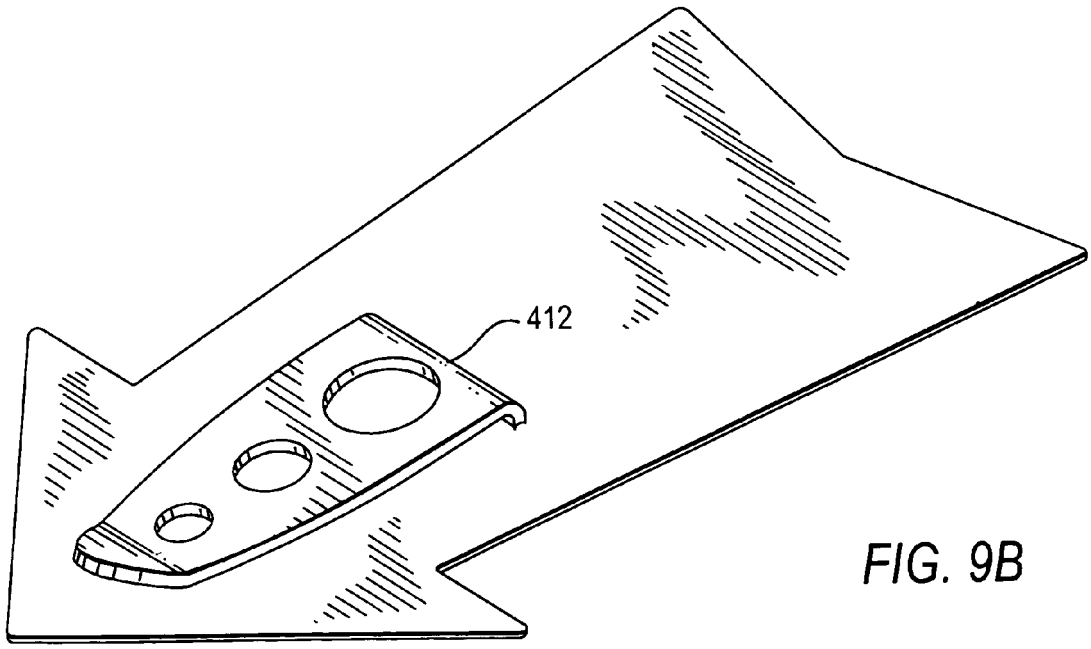
Figure 9C:
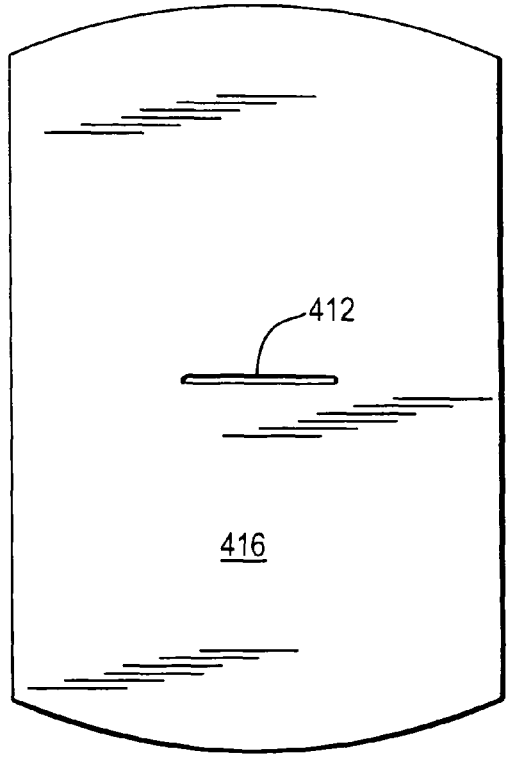
Figure 13:
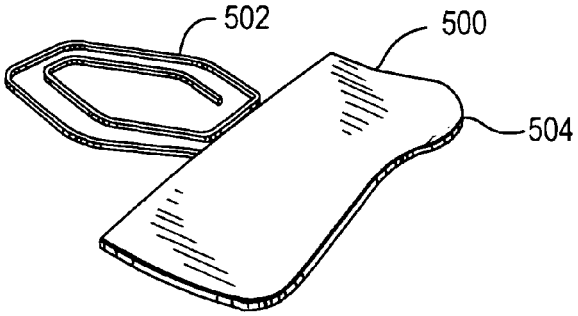
Figure 14:
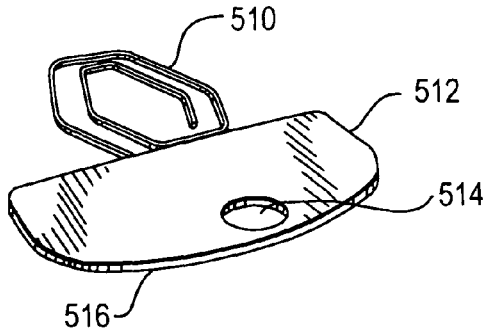
Figure 10A:
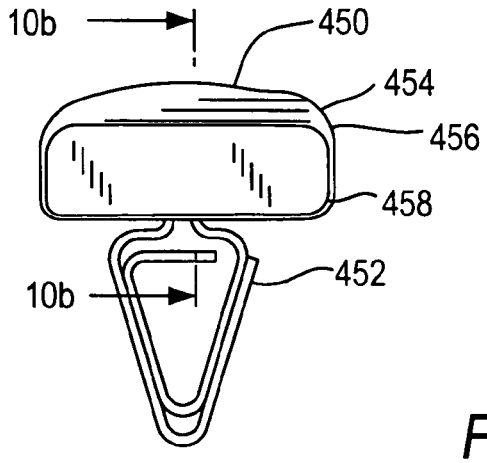
Figure 10B:
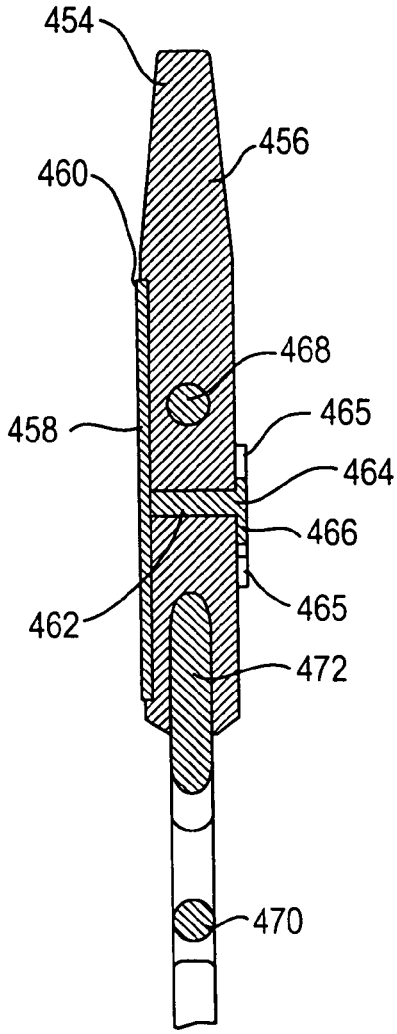
Figure 11A:
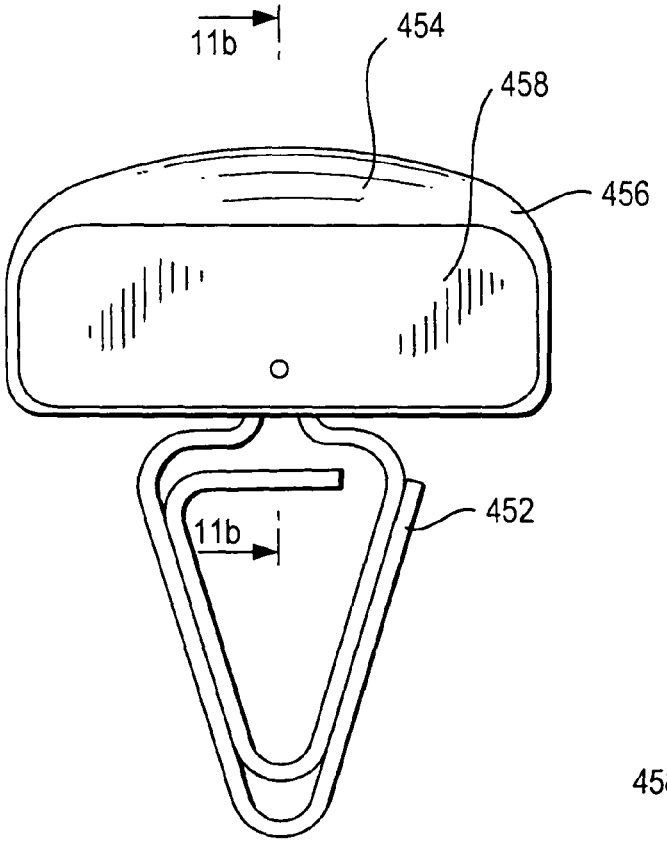
Figure 11B:
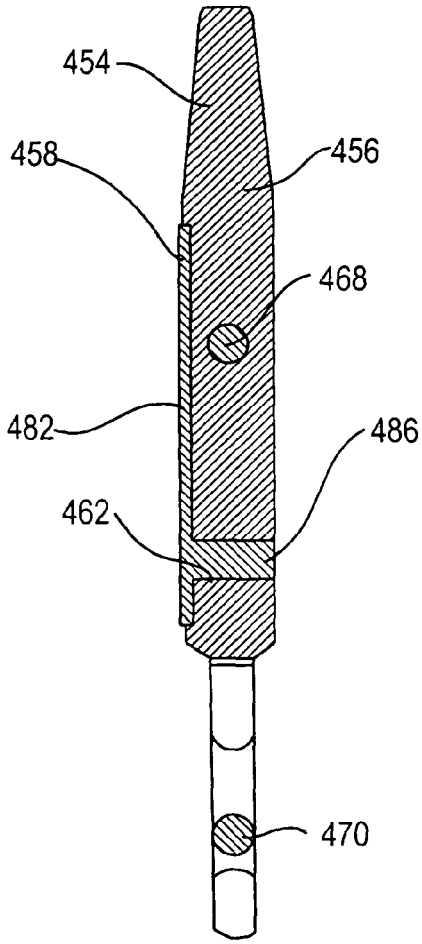
Figure 12:
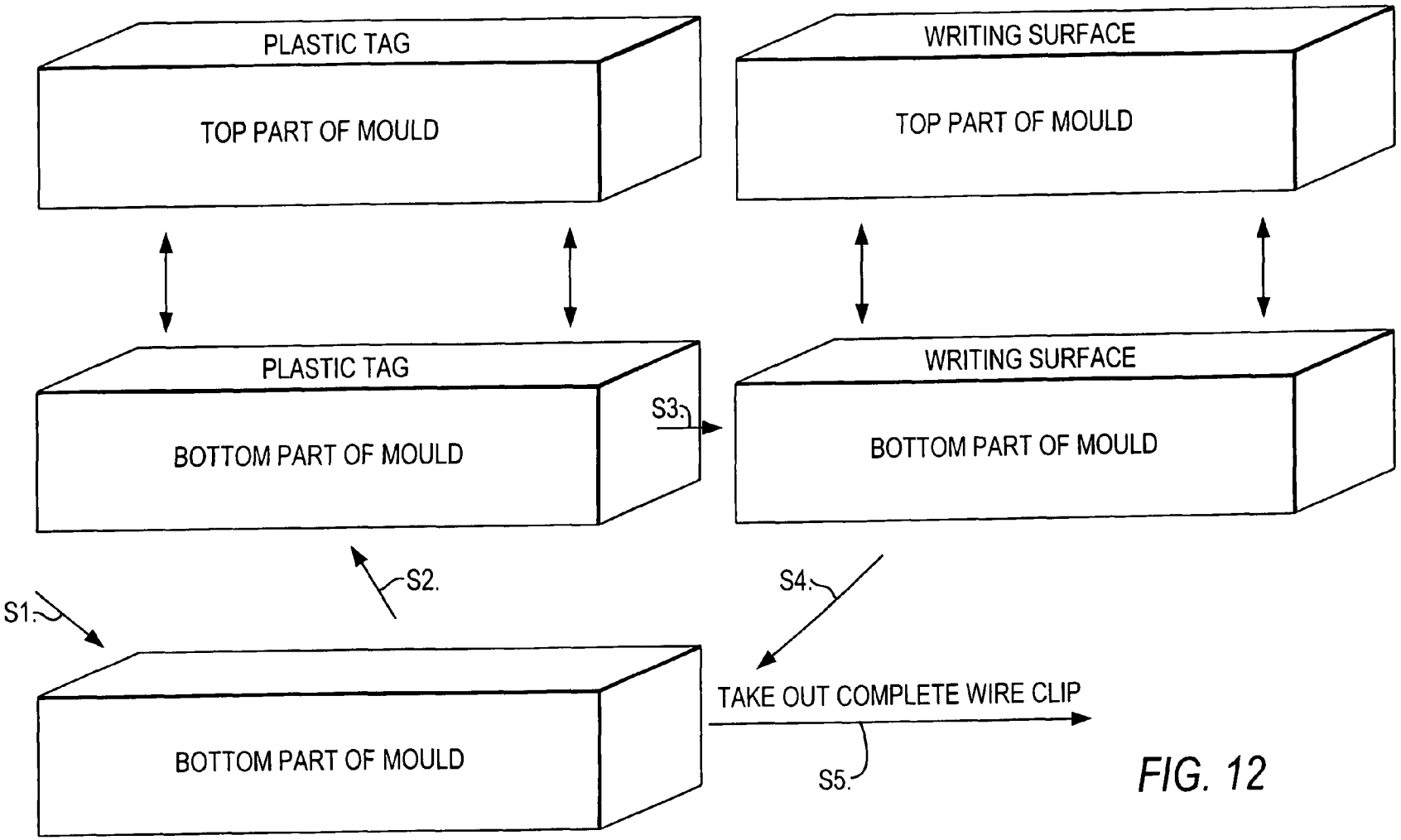

FIG. 6 shows yet a further embodiment of the present invention;

FIG. 7 shows another clip embodying the present invention;

FIG. 8A shows a further clip embodying the present invention;

FIGS. 8B and 8C showing how the clip of FIG. 8A is attached to a sheet;

FIG. 8D shows the clip of FIG. 8A attached to a sheet;

FIGS. 9A-9C show a further embodiment according to the invention;

FIGS. 10*a* and 10*b* show an embodiment of the present invention where a thermal bond is provided between rubber material on which an image can be marked and the plastics material forming a tab part in addition with a form locking connection;

FIGS. 11*a* and 11*b* show another embodiment similar to that of FIG. 10, but without the form locking connection;

FIG. 12 shows schematically a method for manufacturing a clip embodying the present invention;

FIG. 13 shows a clip embodying the present invention with a flipping tab; and FIG. 14 shows a clip embodying the present invention with a hanging hole.

DETAILED DESCRIPTION OF THE PREFERRED EMBODIMENTS

In the described embodiments of the present invention, the clip is arranged to be attached to one or more sheets of paper, card, a folder, a diary, a book or the like.

Figure 1A:
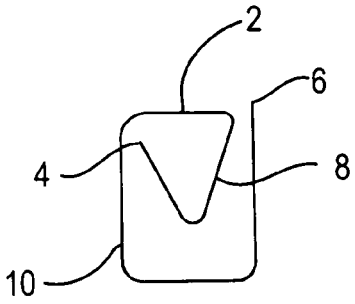
FIG. 1A shows a wire clipping part.
Figure 1B:
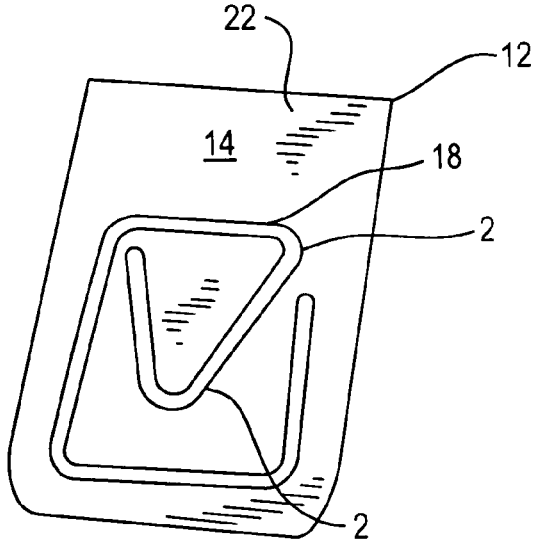
FIG. 1B shows the wire clipping part of FIG. 1A when included in a paper/plastic sandwich from the front providing a clip.
Figure 1C:
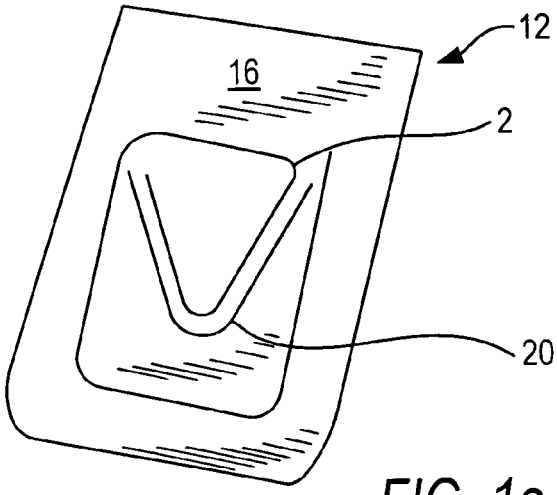
FIG. 1C shows the clip of FIG. 1B but from the rear.

Reference is now made to FIGS. 1A to 1C which show a first embodiment of the present invention. FIG. 1A shows the clipping part 2 of the clip 12 shown in FIGS. 1B and 1C without the writeable material attached thereto. The clipping part is preferably of wire similar to that used by conventional wire paperclips but can be of any suitable material such as plastic or the like.

The clipping part 2 has a first end 4 and a second end 6. Starting from end 4, the wire adopts a V shaped configuration 8. From the end of the V different to end 4, which extends outwardly from the end portion 4 by a small amount, a substantially rectangular portion 10 is defined which surrounds the V and ends with end portion 6 of the wire. The clipping part 2 shown in FIGS. 1*b* and 1*c* is then sandwiched between two layers. FIG. 1*b* shows the upper surface of the resulting clip 12 while FIG. 1*c* shows the back surface of the clip construction 12. The clip 12 is defined by sandwiching the wire clip 2 between two layers which are joined together by an adhesive or by any other suitable technique.

In one embodiment, the upper surface 14 comprises paper while the rear surface 16 comprises a plastic material. As shown in FIG. 1*b*, the front and back sheets define a region 18 in which the clip is accommodated. The upper surface 14 of the clip 12 may be opaque. However, the portion 18 would be visible from the front as a raised region with respect to the remainder of the surface of the upper surface.

A cut 20 is provided below the V shaped portion 8 of the clip. The cut 20 is positioned so that the wire clip is not exposed by the cut. Accordingly, the cut 20 is spaced from the V shaped portion 8 of the clip 4 by a suitable distance. This cut 20 is provided through both the first layer 14 and the second layer 16. In an alternative embodiment, the cut may only extend through the first layer with the papers held by the clip being between the first and second layers.

The second layer 16 is one embodiment of the present invention is transparent. This means that the clipping part 2 may be visible. In embodiments of the invention, one or both of the layers may be transparent. This can be either the top layer 14 or the back layer 16. Likewise, one or other or both of the layers may be opaque. Again, this can be the top layer 14 or the back layer 16. The material to make the various layers can be selected as appropriate. At least one of the layers comprises a writable material, such as paper or suitably treated plastics.

It should be understood that, if in one embodiment of the invention, the material of the layer may itself be not able to be written on but a further portion is provided on that layer on which the user can write. The layers can comprise any suitable material, such as paper, card, plastic, foil, metal, metal covered plastic or any other suitable combinations thereof. In preferred embodiments of the present invention, one layer, preferably but not necessarily, layer 14 has a portion or itself is of a material on which the user can write with any suitable writing instruments such as a ball point pen, felt tip marker, pencil or the like. It is also possible that the area on which the user is to write be of a plastics material which requires a particular type of marker, such as a waterproof marking pen to write thereon. It should be appreciated that embodiments of the present invention, the user may be able to write on both sides of the clip.

The clip preferable has a portion 22 which extends above the clipping part 2. Thus, when the clip 12 is attached to a sheet of material, the portion 22 will extend from the sheet of paper and thus be visible, this portion 22 thus acts as a marker or indexing portion.

The two layers of material 14 and 16 may be blistered/hot formed about the clipping part 2. The two layers may be stuck to one another by means of an adhesive. The two layers may be stuck together using laminating techniques. Alternatively, the layers may be made of such material that the application of heat and/or pressure causes the two layers to adhere together.

It should be appreciated that the shape of the basic wire paperclip can take any suitable format. For example, the rectangular part of the clip may be replaced a U shaped portion, another V shaped portion or indeed any other suitable shape. The V shaped portion itself maybe U shaped, square, semi circular or any other suitable shape.

In use, the sheet or sheets of paper or card are inserted between the V shaped portion of the clipping part and the rectangular portion 10 of the clipping part. This is by means of the opening 20 provided in the clip 12. The tab portion 22 will protrude from the top of the sheets of paper or the like.

Figure 2:
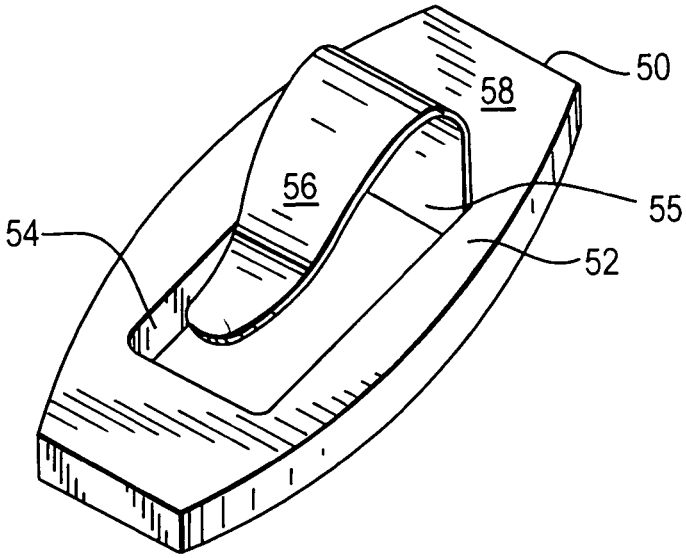
FIG. 2 shows a second clip embodying the present invention.

Reference will now be made to FIG. 2 which shows a second embodiment of the present invention. The clip 50 can be made out of any suitable material. In preferred embodiments of the present invention, the clip shown in FIG. 2 is made out of a sandwich material having an external layer of a writeable material with at least one other layer to provide strength. Accordingly, the sandwich may have any one or more of the following materials: paper; plastics; foil; metal; textiles and foil paper. In one embodiment of the invention, the clip is formed from planar material which is hot formed into the desired shape.

The clip 50 comprises a base 52. The base 52 can take any suitable shape. In the embodiment shown in FIG. 2, the base 52 is generally rectangular in shape with the two long sides thereof being outwardly curved. The base can be rectangular, square, triangular, or indeed any other suitable shape.

The base 52 has an opening 54 which is generally rectangular in shape. This opening 54 can of course can any other suitable shapes such as U shaped, V shaped, square, circular etc. Extending from one side 55 of the opening 54 is a resiliently mounted or sprung tongue 56. The tongue 56 extends from side 55 and out of the plane containing the opening 54. The tongue 56 then slops downwardly into the plane containing opening 54. Thus, when the paper or the like is inserted under the tongue 56, the resiliently mounted tongue 56 will tend to push the paper or the like down into the plane containing opening 54 thus allowing the papers to be retained in place.

The base has a portion 58 extending from side 55 of the opening. Portion 58 is arranged so that when one or more papers are retained in position by the tongue 56, portion 58 will project from the papers. Portion 58 contains will have a writeable surface either from the nature of the upper layer of the material itself or because a writeable portion has been applied to this region. In some embodiments of the present invention, the clip shown in FIG. 2 may be of a plastics material.

The tongue 56 can have any suitable shape such as V shaped, U shaped, rectangular or square. The extent by which the tongue rises about the plane of opening 54 will determine how many sheets of paper or thickness of material that can be accommodated under the tongue 56.

FIGS. 3*a* to 3*b* show a further embodiment of the invention. The user is supplied with clips 70 together with a supply of pre-cut cards 72. The clip 70 is arranged to be attached to the piece of card 72 as will now be described.

The clip can have any suitable structure. In the embodiment shown, the clip 70 has a first clipping part 74 and a second clipping part 76 which are arranged to hold material therebetween. The first and second clipping parts 74 and 76 are each generally in the shape of an "m". The first and second clipping parts are connected at a first point 78 at the beginning of the "m" and at a second point 80 at the end of the "m". The middle part 84 of the "m" of the first clipping part is not joined to the middle part 82 of the second clipping part 76. The middle part 84 of the first clip is arranged to define a circular part at the end thereof. The middle part 82 of the second part comprises two separate legs side by side. Thus the ends of the two legs at the bottom of the middle part are not joined together. The lowest points of the two middle parts 82 and 84 may be at the same level. This level is above the level of the base of the "m"s.

The middle part 84 of the first clipping part may be arranged to define an arc above the plane containing the clip. In this embodiment, the top of the first clipping part 74 is lower than the top of the second clipping part 76.

The card 72 has a slot 86 which is arranged to receive the clip. FIG. 3*b* shows the clip in position. One of the "m" is arranged on one side of the card and the other "m" is arranged on the other side of the "m". The card has a portion 88 on one side of the slot such that when the clip with the card is arranged on a sheet of paper 90, the portion 88 extends out from the edge of the paper to form a tab portion.

Reference is made to FIG. 3*c* which shows a modification the embodiment of FIGS. 3*a* and *b*. The clip as shown in FIGS. 3*a* and *b* is arranged to be used with card which has a backside with a hot sealing foil. When the clip is attached to the card, a second layer 92 is arranged to be applied to the side of card on which the first or the second clipping part is in contact. The second layer is a paper with hot sealing foil. If the backside of the card is used as the front area, then a larger writing area is provided. In one modification, a pocket is formed with two sides joined together. The pocket is accessed from one side by a slot into which part of the clip is inserted and the other part of the clip is external to the pocket. The card and the layer may alternatively be bonded by adhesive provided on one or other of the card and layer.

Reference is made to FIGS. 9*a* to 9*c*. These figures show an embodiment using the same principle as that illustrated in FIG. 3. The clipping part 400 is shown in FIG. 9*a* and comprises a first part 402 joined to a second part 404 with one part overlying the other. The two parts may be biased one towards the other. The two parts are joined at one end 406 and are both free at the other end 408 to thereby receive papers or the like there between. The end 406 has a depth which separates the two parts at that end and defines the maximum thickness of material that can be accommodated by the clip. The second part is the underlying part and is generally planar. The first part is the overlying part and has a first portion 410 which extends from end 406 down towards the second part. A second portion 412 of the first part is at the end 408 of the clip and extends away from the second part. It extends in a direction such that the maximum distance between the first and second parts is right at the end of the first part. This is to facilitate the pushing of the clip onto an item to be clipped.

As with the embodiment in FIG. 3, the clip of FIG. 9*a* can be received in a slot 412 of a piece of card, plastics or the like 414. In the embodiment shown in FIG. 9*b*, the card or the like 414 is in the shape of an arrow. An alternative shape is shown in FIG. 9*c* where the card is generally rectangular with two curved ends. The card or the like can take any other suitable shape.

As demonstrated by FIGS. 3*a* to 3*c* and 9*a* to 9*c*, the clip can take any suitable shape or form and the card or the like can also have any suitable shape and size.

FIG. 4 shows a further embodiment of a clip 100 embodying the present invention. The clip has a wire part 102. The clip also has a tab portion 104. In the embodiment shown in FIG. 4, the wire part 102 comprises a first inner V portion 106 and a second outer V portion 108. The two V portions are connected together by a portion 110 of the clip which adopts an ovoid type configuration as shown in dotted lines in FIG. 4. In an implementation, the tab 104 comprises a two piece plastic member which is hinged along end on side opposite the wire part 102. The wire part 102 and in particular portion 110 is inserted between the two sides of the tab 104 and the two sides of the tab portion are closed. Any suitable mechanism can be used for holding the two parts of the tab together such as a push fit, a snap fit, locking members, adhesive or the like.

The wire part 102 is preferably made of wire, resilient plastic or the like. The tab 104 is preferable made out of a plastics material. The tab portion may be written on by a suitable marking pen or may have material applied thereto which allows the user to write thereon. Examples of such a material include certain types of plastic and paper layers.

In one modification to the arrangement shown in FIG. 4, the clip may have the same general configuration but may be molded in a single piece out of one material. In another modification to the invention, the tab part 104 may be molded on to the clipping part 102.

When the sheets of material or the like are clipped between the two Vs 106 and 108, tab portion 104 will project from the top of the sheet of material and can thus act as an index or marking part. The tab portion may have any other suitable shape and for example may be circular, oval, triangular, flower shaped, arrow shaped, exclamation mark shaped, question mark shaped, star shaped or the like. The tab portion may be opaque or transparent. The tab portion may have a planar surface or alternatively the tab portion may have a curved surface.

It should be understood that the shape of the clipping part in the tab portion can have any suitable shape. For example, the clip may be an inverted u-shape, a square shape, an inverted v-shape, a rectangular shape, a triangular shape or the like.

FIGS. 5*a* and *b* show a further clip 130 according to the present invention. The clip 130 is made a one piece clip of a plastics material. The plastics material comprises a first part 134 contained in a first plane and a second part 136 at least partially in a different plane. The first part 134 in the first plane has a portion 138 to which a writeable area is attached. The first portion 134 has an opening 140 which in this example is generally in the shape of a half circle. The outer perimeter of the first portion 134 around the opening 140 is a similar shape. Thus, the first portion 134 comprises a unshaped portion about the opening. Attached to a wall across the straight side of the half circle is wall 139 which extends perpendicularly away from the first plane. This is attached to tongue 136. Tongue 136 is resiliently biased downwardly towards and preferably into the opening 140 of the first portion 134. The size of wall 139 determines the number of papers which can be accommodated by the clip. The wall 139 may be substantially flat or may be curved.

FIG. 5*b* is a cross-section along line A-A of FIG. 5*a*. As shown, the walls defining the u-shaped part 134 have a height h1 adjacent the outer perimeter of the clip 134 and a height h2 adjacent the opening. The height h1 is greater than the height h2. The top part 141 of part 134 between the parts with heights h1 and h2 slopes down from the part with height h1 to the part with height h2. This means that the paper is not creased when it is put into the clip.

In preferred embodiments of the present invention, the clip shown in FIGS. 5*a* and 5*b* can be made of molded plastics material. The region 138 may be arranged to be written on by a waterproof marker pen but in preferred embodiments of the invention is coated with a suitable material on which the user can write with any writing instrument such as a ball point pen, felt tip or pencil.

FIG. 6 shows a further embodiment of 150 of a clip embodying the present invention, the clip 150 is generally T shaped in configuration. The clip has a first portion 153 which has opening 152 with a square U configuration. A tongue 154 is provided in this cut out portion. In use, paper is inserted between the tongue and the part 153 to thus retain papers in position. This is defined by the vertical part of the "T". Portion 156 projects above the paper or the like. This is the top of the "T". This part is of a writeable material or has a writeable layer applied thereto. The clip can be made of any suitable material such as plastic or metal.

FIG. 7 shows a further clip 180 holding a sheet of paper 182. The clip shown in FIG. 7 operates using the same principles as that shown in FIG. 6 but the shape of the clip is different. The outer contour of the clip 180 is generally that of a figure eight. There is a generally semi circular opening 184. The tongue portion (not shown in FIG. 7 as it is behind the sheet of paper 182) has a similar shape. The projecting part 186 of the clip is generally semi circular and either is of writeable material or has a writeable layer applied thereto. It should be appreciated that the clips of FIGS. 6 and 7 are generally flat.

FIGS. 8*a* to 8*d* which show a further clip embodying the present invention. The clip 300 has a first side 302 and a second side 304. Side 302 is arranged to contact one side of a sheet bundle or the like and side 304 is arranged to contact the other side. The clip is manufactured from a resilient material such that the sides 302 and 304 are biased, at least towards their edges, towards each other. The two sides 302 and 304 are joined by spine portion 306. Spine portion 306 extends along only part of the length of the respective edges of sides 302 and 304. On side 302, a tab portion 308 is provided. Tab portion 308 extends generally in the same plane as side 302 and outwardly from spine portion 306. Thus, in use, the top of a sheet of paper will contact with the inner surface of spine portion 306 and tab portion 308 thus projects outwardly. As far as side 304 is concerned, the part of the side contiguous with region 306 is free.

Reference is now made to FIGS. 8B to 8D which show how the clip 300 is used in practice. The clip 300 is slid onto a sheet of paper. In particular, the clip is moved in a direction towards the sheet or paper along the axis of spine portion 306. The sheet of material is thus guided between side 304 and 302 with its tab portion 308. The clip is moved until the edge of sheet contacts the beginning of spine 306. This is shown in FIG. 8B. Then, the clip is rotated about point 310 i.e. the beginning of spine portion 306, next to where the tab portion starts. The clip is then rotated until spine 306 is in contact with the edge 320 of the sheets of paper 318. This is shown in FIGS. 8C and 8D. As can be seen, the tab portion 308 thus projects from the edge 320 of the sheet of paper.

The clip can have any suitable shape. In the arrangement shown in FIGS. 8A to D, each side 302 and 304 has a shape generally corresponding to a quarter of a circle. However, these portions can be square, rectangular, curved in other ways or the like.

In one embodiment of the present invention, a cut out portion 322 is provided on at least one surface, for example, surface 304. This cut out portion has an arrow with an arrow head 306 defined adjacent to the end of side 304 remote from spine portion 306 and adjacent tab portion 308. The body of the arrow is curved and generally follows the curved edge 316 of the upper surface 304. This is for decorative purposes and could be any other shape. The arrow head is used to show the user the direction in which the clip needs to be moved in order to be slid on to the sheets of material.

The clip shown in FIGS. 8A to 8D can be made of any suitable material such as plastics or metal. The clip shown in FIGS. 8A to 8D may be particularly useful for thicker material. In such cases, metal may be the preferred medium.

The tab part of the clip may be of or have a layer of any suitable material on which the user is able to write using a pen, ball point pen, pencil, felt tip or any other suitable writing instrument. Embodiments of the invention provide the advantage that the user does not have to have a special marker in order to write on the tab. The layer or material which is writable can be any suitable material and by way of example may be paper, certain types of plastic, rubber, rubber compounds. For example rubber or rubber compounds have a Shore Hardness of around 95 can be used. The Shore Hardness may be at least 70. More preferably the Shore Hardness is at least 80. Preferably, the Shore Hardness is between 70 and 90. The writable portion may be such that images written with certain writing instruments such a ball point pen, felt tip pens, or pencil can be erased with for example thermoplastic or the like erasers. The clipping part may be made of any suitable material such as wire, metal, steel, plastics or the like.

Reference is now made to FIGS. 10*a* and 10*b* which illustrate an embodiment in which a thermal bond is formed between the plastic material and the rubber material. Additionally, there is also a locking structure formed which holds together the rubber and plastics material. The plastics material can be from any suitable material such as for example PP (polypropylene) or any type of PS (polystyrene, high impact polystyrene) or ABS (Acrylonitrile Butadiene Styrene). The rubber material can be any suitable material such as TPR (thermoplastic plastic rubber) or any kind of TPE (thermoplastic elastomer) such as for example SBS (styrene butadiene styrene).

The clip 450 shown in FIG. 10*a* has a structure similar to that illustrated in FIG. 4. The clipping part 452 has a similar shape to that illustrated in relation to FIG. 4 and will not be described in any further detail. It should be appreciated that the clipping part 452 may be made out of wire, any suitable plastics material or the like. The clipping part 452 is attached to a tab portion 454. The tab part 454 comprises a suitable plastics material, such as discussed above, having an indented portion 458 in which a suitable rubber portion is received. This can be seen from FIG. 10*b* which illustrates the clip of FIG. 10*a* in cross section. As can be seen, the tab part 454 comprises the first part 456 made of plastics material. This is shaped so as to have an indented portion 460 into which the rubber layer 458 is received. Additionally, there is a through hole 462 which runs through the plastics part 456 to the rear thereof. This through hole 462 is filled with rubber. In particular, during the molding process of the clip, which will be described in more detail later, the rubber is fed in from the rear 464 of the hole 462. The rubber fills up the insert 460 on the front of the tab, fills up the opening 462 and additionally provides a small portion 466 which extends across the opening. The small portion 466 effectively forms a T with the rubber in the opening 462. In this way, the rubber not only can thermally bond to the plastics material but is also physically held in place.

Also shown in FIG. 10*b* and referenced by numeral 465 is a part of raised writing or a logo or the like formed on the back surface of the clip. This is optional. The writing or logo or the like is formed of the same material as part 456 of the clip. In preferred embodiments of the invention, where the raised writing, logo or the like is provided, the surface of the writing or the like is coplanar with the surface of the rubber portion 466. Cross-section area 468 is part of the clipping part 452 retained in the tab. Also shown in FIG. 10*b* is the cross section 470 through one of the wire arms of the clipping part 452. Cross sectional area 472 represents a vertical part of the clipping part which is partly received in the tab portion and partly external thereto.

The embodiment shown in FIGS. 10*a* and 10*b* has the advantage that the additional locking provided by the rubber itself means that the thermal bond between the rubber material and the plastics material does not need to be particularly strong. This means that the most appropriate selection of materials can be made without requiring a good thermal bond to be achievable.

FIGS. 11*a* and 11*b* show a modification to the embodiment of FIG. 10*a* and 10*b*. In this embodiment, the rubber material and plastic material are only held together with a thermal bond. In other words, the physical holding together of the plastic and rubber material is omitted. In order to achieve a proper connection between the rubber material and the plastics material, the compatibility of these materials is more important. In particular, the chemical structures of the thermoplastic and the rubber material need to be compatible, for example, similar. Combinations which have been found to be useful comprise TPE, which is based on PP and PP, or SBS (styrene-butadiene-styrene elastomer) and PS. However, it should be appreciated that this is by way of example only and any suitable plastics material which is compatible with a corresponding rubber material can be used together.

Those parts which are similar or the same as shown in FIG. 10 are marked with the same reference number. The main difference between the embodiment of FIG. 10 and FIG. 11 is that the rubber is introduced via the feed point 486 into the opening 462. This causes the rubber writeable area 458 to be formed. However, no rubber extends beyond the opening formed in the plastics material 456 on the back of the tab portion. In other words, the rubber in the opening is flush with the plastics surface. Thus, the arrangement of FIG. 11 relies solely on the thermal bond between the rubber and plastics material to form the connection. In addition, the through hole 462 is positioned in a different place than that of the embodiment shown in FIG. 10. In FIG. 10, the through hole 462 is positioned around a central region of the writeable material 458. In the embodiment shown in FIG. 11, the through hole 462 is provided in the vicinity of an edge region of the writeable material 458. However, it should be appreciated that this is a matter of design choice. Where the form locking connection is also being formed, it generally is desirable to have the through hole formed in a central region thereof. However, where there is no form locking connection, the hole can be positioned as required. It should also be appreciated that the cross section shown in FIG. 11*b* is taken at a slightly different position and accordingly, the cross section through part of the clip 472 is not shown.

FIG. 12 schematically shows the molding process for forming clips embodying the present invention according to FIG. 11. Firstly, in step S1, a bottom part of the mold is taken and the clipping part is placed partly in the bottom part of the mold. The mold is used to form the tab part. Next in step S2, the top part of the mold is fitted to the bottom part of the mold. This is to provide the plastics part of the tab. The plastic material is injected into the mold and this will form the plastic part of the tab as for example shown in the cross sections of FIGS. 11*a* and 11*b*. The wire clipping part will then be joined to the plastics part. Next in step S3, the top of the mold used to form the plastic tag is removed and it is placed with a second different top part of the mold. This is to allow the rubber part of the tab to be formed. The rubber material is injected into the mold and forms the rubber areas shown in FIG. 10 or 11. In step S4, the top part of the mold is removed and then in step S5, the bottom part of the mold is removed to provide the clip. Vertical injection molding is used in preferred embodiments of the invention.

In embodiments of the present invention, the tab part can take any suitable form.

It should be appreciated that the method described in relation to FIG. 12 can be modified to produce the clip shown for example in FIG. 10. To achieve this, the bottom mold would need be provided with removable sliders. The first slider part, when attached to the bottom of the bottom mold would enable the plastics parts to be formed including the writing, logo or the like. This would be in place until step S3 at which point the slider would be removed and replaced with another slider. This would enable the rubber portion 466 to be formed. The removable sliders can be inserted and removed using any suitable action such as by sliding or by clipping into position or by any suitable technique.

FIG. 13 shows a first modification to the tab part. In particular, when the clip is attached to a sheet of paper and the papers are in a pile, a curved part or a tab(flipping portion) 504 projects out further than the rest of the tab portion 500. The protruding portion can of course take other suitable shapes. This facilitates flipping, i.e. wherein the user going through piles of paper which are separated into different bundles held together by different clips. Because the area 504 protrudes beyond the end of the tab portion 500 this makes it much easier to flip through piles of documents. It is also intuitive to use. It should be appreciated that in the embodiment shown in FIG. 13, the clipping part is generally hexagonal in shape as apposed to the triangular shapes illustrated in the other embodiments. It should be appreciated that the different shaped clipping parts of the other embodiments can be used alternatively in the embodiment shown in FIG. 13. The embodiment shown in FIG. 13 is of the same basic structure as that illustrated in relation to FIGS. 10*a* to 10*b* or FIGS. 11*a* to 11*b*, that is has a plastic tab portion on to which rubber material is provided.

FIG. 14 shows a further embodiment of the present invention where the tab part 512 has a curved upper edge 516. The tab portion also has a through hole 514. This hole allows users to attach a push pin or other device to attach one or more documents to a bulletin board, cube wall or other surface that can be used for such purpose. Thus, users can attach several groups of documents in one location and use clips to quickly identify documents, thus saving wall space. The clipping portion 510 is similar to that shown in FIG. 13 and again can take any suitable shape. The provision of a through hole can be provided in any shape of tag, and not just as shown in FIG. 14. The hole is preferably located in the central region of the clip but in some embodiments of the present invention may be positioned for example at one end region of the tab portion. The hole can be circular or any other suitable shape.

In one embodiment of the present invention, the plastic material may be blue or any other suitable color and the write and erase rubber material already discussed, may be white. The rubber material can be flowed on to the plastic.

The triangular clipping part used in some embodiments has the advantage of increasing gripping ability without creasing or damaging plastic. However, as mentioned previously, the clipping part can take any suitable form.

Embodiments of the present invention have described the presence of a tab portion on which the user is able to write. It should be appreciated that in some embodiments of the present invention, clips with pre-printed portions may be provided on the clips. The pre-printed words can be any suitable words such as for example "sign here"; "section 1": "part 1"; "index"; "read"; "news"; "project" or the like.

It should be appreciated that embodiments of the present invention can be provided in any suitable shape. Any aspects of any embodiment can be combined with any aspect of any other embodiment.

What is claimed is:

1. A clip comprising:

a clipping part for clipping to an object; and a tab part arranged to extend from the clipping part, with the tab part comprising:

a first portion made of a plastics material, and a second portion configured and having sufficient dimensions for writing upon and being made of a rubber material that is writable upon by ink from a pen;

wherein the plastics material and rubber material are configured to have a form locking connection therebetween, and the form locking connection is made of the rubber material and extends from the second portion through the first portion, to a side of the first portion opposite the second portion.

2. The clip of claim 1, wherein the plastics material comprises at least one of polypropylene or polystyrene.

3. The clip of claim 1, wherein the rubber material comprises a thermoplastic rubber or thermoplastic elastomer.

4. The clip of claim 1, wherein the plastics material and rubber material are bonded together.

5. The clip of claim 1, wherein the rubber material has a Shore Hardness of between 55 to 95.

6. The clip of claim 1, wherein the rubber material has a Shore Hardness of between 70 and 90.

7. The clip of claim 1, wherein the clipping part is partially received in the tab part.

8. The clip of claim 1, wherein the rubber material is overmolded construction on the plastics material.

9. The clip of claim 1, wherein the tab part further comprises a third portion comprising a raised portion that is raised above the second portion.

10. The clip of claim 9, wherein the raised portion comprises at least one of writing, a logo, a design or a picture.

11. A method of making the clip of claim 1, comprising:

inserting the clipping part into a first mold part of a mold;

closing the mold with a second mold part of the mold;

injecting the plastics material into the closed mold to provide the first portion;

removing one part of the mold and replacing it with a third mold part;

introducing the rubber material into the mold with the replaced third mold part to thereby product the second portion molded over the first portion; and removing the clip from the mold.

12. The clip of claim 1, wherein the clipping part comprises a material markable with ink from a pen.

13. The clip of claim 12, wherein the clipping part material comprises at least a metal or a plastic.

14. The clip of claim 12, wherein the tab part is molded onto the clipping part to form an integral clip.

15. The clip of claim 12, wherein a part of the clipping part is received in the tab part.

16. The clip of claim 12, wherein the clipping part is made of the plastics material.

17. The clip of claim 12, wherein the clip has a one piece structure so that the tab part and the clipping part are integral.

18. The clip of claim 1, wherein the first portion extends beyond and around lateral edges of the second portion.

19. The clip of claim 1, wherein the second portion is supported by the first portion, and the second portion is supported from the clipping part.

20. The clip of claim 1, wherein the form locking connection is exposed from the first portion on said opposite side.

21. The clip of claim 1, wherein the tab part comprises a third portion of the rubber material disposed on the opposite side of the first portion from the second portion, and the rubber material of the form locking connection extends through the first portion from the second portion to the third portion.

22. A clip comprising:

a clipping part configured for clipping to an object;

and a tab part arranged to extend from the clipping part, the tab part comprising:

a first portion made of a plastics material, a second portion supported by the first portion and configured and dimensioned for writing upon and being made of a rubber material that is writable upon with ink from a pen, and a form locking connection made of the rubber material connected to the second portion and extending therefrom completely through the first portion to be exposed from a side of the first portion opposite the second portion.

23. The clip of claim 22, wherein the tab part further comprises a third portion of the rubber material connected to the form locking connection and raised above the first portion.

* * * * *